US009044912B2

(12) United States Patent
Futamura et al.

(10) Patent No.: US 9,044,912 B2
(45) Date of Patent: Jun. 2, 2015

(54) OPERATION METHOD OF ELECTRIC PRESS WORKING MACHINE

(75) Inventors: Shoji Futamura, Zama (JP); Chikara Murata, Zama (JP); Tatsuya Takahashi, Zama (JP); Atsumori Inada, Zama (JP); Tetsuya Yoneda, Zama (JP)

(73) Assignee: HODEN SEIMITSU KAKO KENKYUSHO CO., LTD., Kanagawa (JP)

( * ) Notice: Subject to any disclaimer, the term of this patent is extended or adjusted under 35 U.S.C. 154(b) by 0 days.

(21) Appl. No.: 13/261,858

(22) PCT Filed: Nov. 21, 2011

(86) PCT No.: PCT/JP2011/006458

§ 371 (c)(1),
(2), (4) Date: May 14, 2014

(87) PCT Pub. No.: WO2013/072979

PCT Pub. Date: May 23, 2013

(65) Prior Publication Data

US 2014/0283695 A1 Sep. 25, 2014

(30) Foreign Application Priority Data

Nov. 15, 2011 (JP) ..... 2011-249821

(51) Int. Cl.

| | |
|---|---|
| ***B30B 13/00*** | (2006.01) |
| ***B30B 15/14*** | (2006.01) |
| ***B30B 1/18*** | (2006.01) |
| ***B21D 22/06*** | (2006.01) |
| ***B21D 22/24*** | (2006.01) |

(52) U.S. Cl.

CPC ..... *B30B 15/148* (2013.01); *B30B 1/186* (2013.01); *B30B 1/181* (2013.01); *B21D 22/06* (2013.01); *B21D 22/24* (2013.01)

(58) Field of Classification Search

CPC ..... B30B 1/186; B30B 1/181; B30B 11/02; B30B 11/04; B21D 22/06; B21D 22/24

USPC ..... 100/35, 39, 193, 237, 289, 290; 72/348, 72/349, 354.8, 379.2; 425/406, 408, 411

See application file for complete search history.

(56) References Cited

U.S. PATENT DOCUMENTS

| | | | | |
|---|---|---|---|---|
| 4,716,755 | A * | 1/1988 | Bulso et al. | 72/349 |
| 5,046,637 | A * | 9/1991 | Kysh | 220/610 |
| 5,309,749 | A * | 5/1994 | Stodd | 72/336 |
| 6,830,419 | B1 * | 12/2004 | Turner et al. | 413/8 |
| 2007/0212438 | A1 * | 9/2007 | Saeki et al. | 425/408 |

FOREIGN PATENT DOCUMENTS

| | | | |
|---|---|---|---|
| JP | 8-155695 | A | 6/1996 |
| JP | 2007-111764 | A | 5/2007 |

OTHER PUBLICATIONS

International Search Report for PCT/JP2011/006458 dated Feb. 7, 2012.

* cited by examiner

*Primary Examiner* — Jimmy T Nguyen

(74) *Attorney, Agent, or Firm* — Sughrue Mion, PLLC

(57) ABSTRACT

An operation method of an electric press working machine including a frame body, a crown, and a plurality of support posts, a first slide that slides on the support posts, a second slide that slides on the support posts, a first-side drive source that drives the first slide, a second-side drive source that drives the second slide, and either a first upper die that is attached to correspond to the first slide or a second upper die that is attached to correspond to the second slide or both. The method includes: a step of moving the first and second slides to a first position; a step of moving the second slide to a second position while keeping the first slide at the first position; and a step of moving the second slide to a third position while keeping the first slide at the first position.

6 Claims, 17 Drawing Sheets

OPERATION METHOD OF ELECTRIC PRESS WORKING MACHINE

CROSS REFERENCE TO RELATED APPLICATIONS

This application is a National Stage of International Application No. PCT/JP2011/006458 filed Nov. 21, 2011, claiming priority based on Japanese Patent Application No. 2011-249821 filed Nov. 15, 2011, the contents of all of which are incorporated herein by reference in their entirety.

TECHNICAL FIELD

The present invention relates to an operation method of an electric press working machine that includes a plurality of slides each of which is raised or lowered by drive means of each slide.

BACKGROUND ART

Conventionally, what is known is a so-called double-slide press working machine that includes, for example, an inner slide and an outer slide; on the slides, for example, an inner-side upper die and an outer-side upper die are respectively mounted; and the double-slide press working machine carries out press working of a to-be-molded article.

The applicant disclosed a high-performance press working machine in which: a plurality of sets of drive means are designed to work together for each slide to apply a force; and the plurality of sets of drive means work together to apply a force to a kind of a center point passing through the center of gravity of each slide; each slide is guaranteed to properly remain horizontal even when each shot in press working is being carried out; and a control system controls in such a way as to prevent an undesirable collision with a plurality of slides or a structure (See Patent Document 1).

PRIOR ART DOCUMENT

Patent Document

[Patent Document 1] JP2007-111764A

SUMMARY OF THE INVENTION

Problems to be Solved by the Invention

The object of the present invention is to propose an operation method of an electric press working machine that is able to ensure flatness of a to-be-molded article and carry out high-precision molding.

Means for Solving the Problems

According to the present invention, an operation method of an electric press working machine at least including a frame body that is formed by using a bed, a crown, and a plurality of support posts, a first slide that slides on the support posts, a second slide that slides on the support posts, a first-side drive source that is so provided as to drive the first slide, a second-side drive source that is so provided as to drive the second slide, and either a first upper die that is so attached as to correspond to the first slide, or a second upper die that is so attached as to correspond to the second slide, or both, wherein the first-side drive source repeatedly raises or lowers the first slide, and the second-side drive source repeatedly raises or lowers the second slide, and a press working operation of processing a to-be-molded article by using a lower die, which is so attached as to correspond to the bed, and both or one of the upper dies is continuously repeated, the operation method characterized by comprising:

a step of moving the first and second slides to a first position;

a step of moving the second slide to a second position while keeping the first slide at the first position; and a step of moving the second slide to a third position while keeping the first slide at the first position.

The operation method is also characterized in that the first position and the third position are the same position.

The operation method is also characterized by comprising:

a step of moving the second slide to the third position while keeping the first slide at the first position;

a step of then moving the second slide to a fourth position while keeping the first slide at the first position; and a step of moving the second slide to a fifth position while keeping the first slide at the first position.

The operation method is also characterized in that:

the first position, the third position, and the fifth position are the same position; and the second position and the fourth position are the same position.

The operation method is also characterized by comprising:

a step of moving the first slide to the second position while keeping the second slide at the first position; and a step of moving the first slide to the first position while keeping the second slide at the first position.

The operation method is also characterized by comprising:

a step of moving the first slide to the second position, and the second slide to the first position;

a step of moving the second slide to the second position while keeping the first slide at the second position; and a step of moving the first slide and the second slide to the first position.

Advantages of the Invention

According to the operation method of the electric press working machine of the present invention, it is possible to ensure flatness of a to-be-molded article and carry out high-precision molding.

EMBODIMENTS FOR CARRYING OUT THE INVENTION

Figure 1:
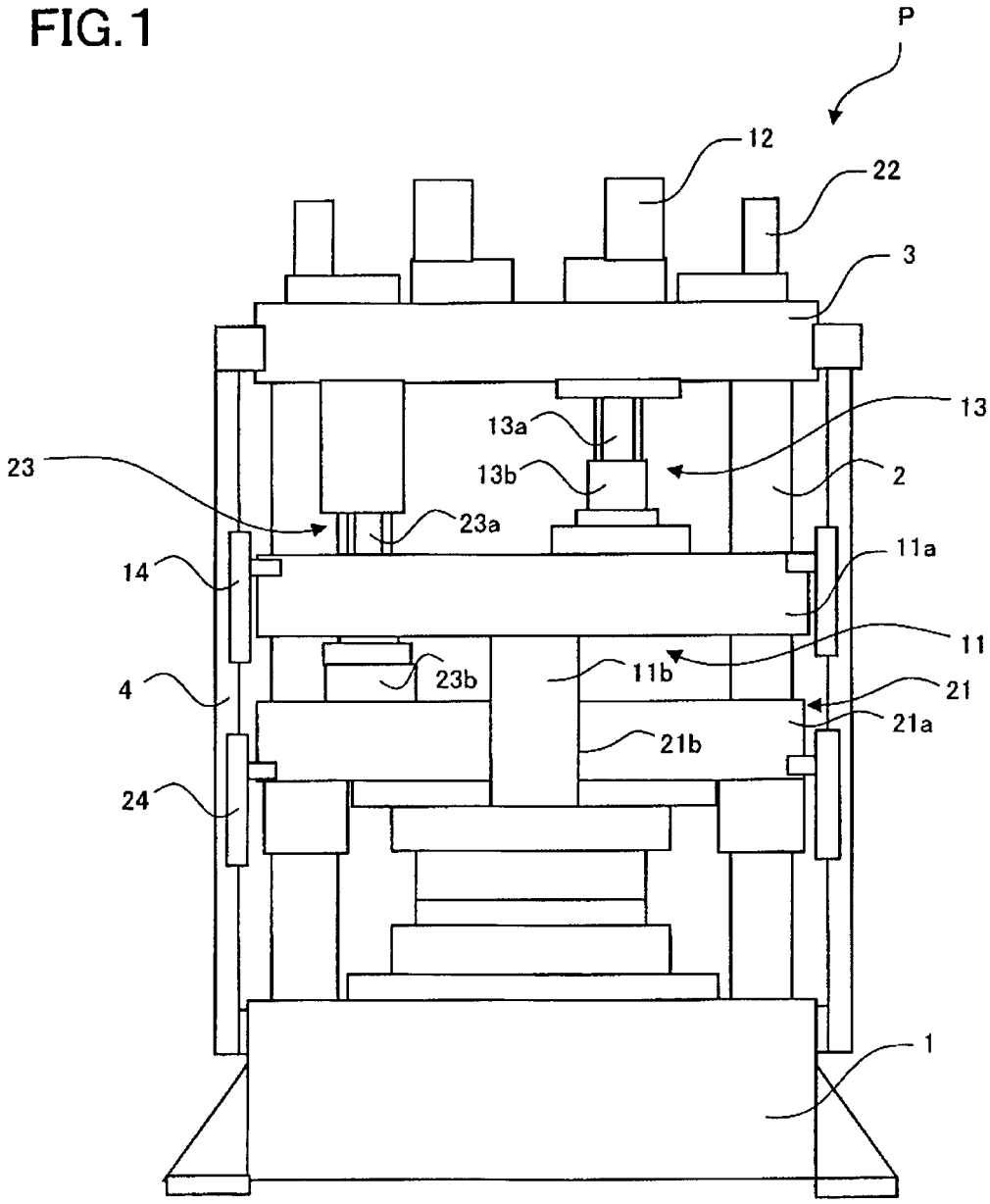
FIG. 1 is a diagram showing the configuration of one example of an electric press working machine.
Figure 2:
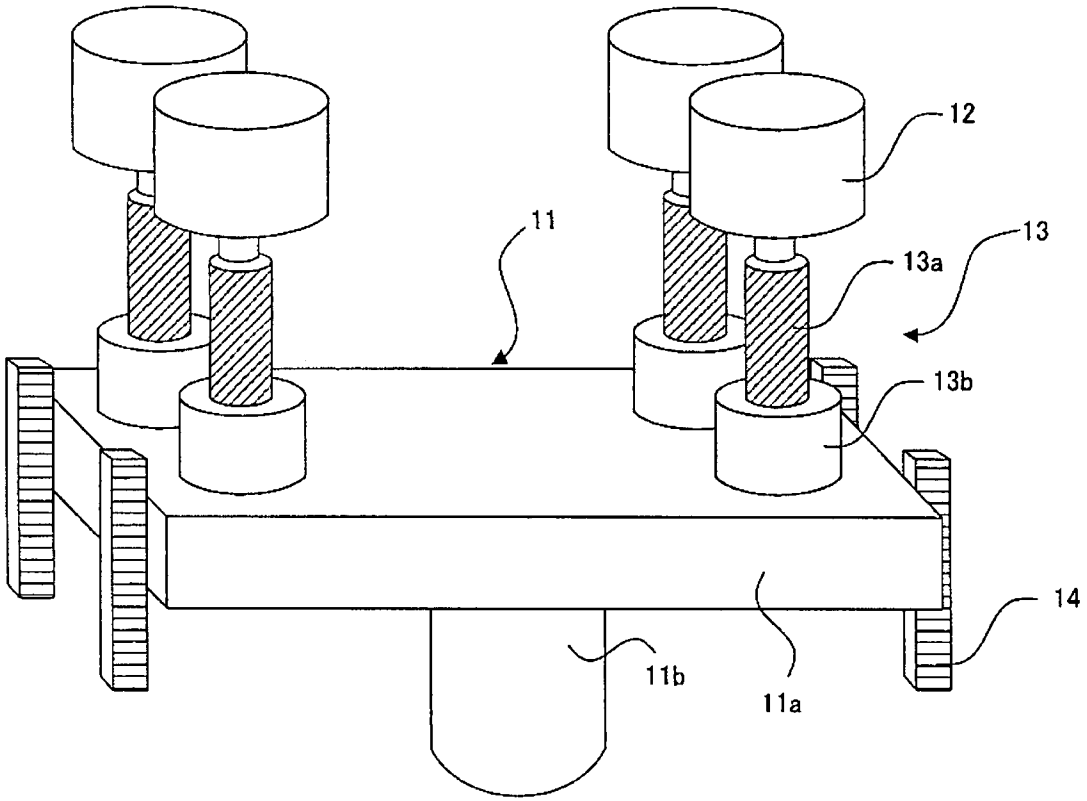
FIG. 2 is a schematic diagram of an inner slide mechanism of the electric press working machine.

FIG. 1 is a diagram showing one embodiment of an electric press working machine P. FIG. 2 is a schematic diagram of an inner slide mechanism of the electric press working machine. Incidentally, FIG. 2 does not show support posts 2, a crown 3, and an outer motor 22.

In the diagrams, the reference numeral 1 represents a bed. The reference numeral 2 represents a support post. The reference numeral 3 represents a crown. The reference numeral 4 represents a scale post. The reference numeral 11 represents an inner slide, which is a first slide. The reference numeral 12 represents an inner motor, which is a first-side drive source. The reference numeral 13 represents an inner ball screw, which is a first-side feed member. The reference numeral 14 represents an inner linear scale, which is a first-side position detection member. The reference numeral 21 represents an outer slide, which is a second slide. The reference numeral 22 represents an outer motor, which is a second-side drive source. The reference numeral 23 represents an outer ball screw, which is a second-side feed member. The reference numeral 24 represents an outer linear scale, which is a second-side position detection member.

The bed 1 is a member that serves as a base to allow the electric press working machine P to be placed on the ground. The support posts 2 are posts extending upward from the bed 1. According to the present embodiment, there are four support posts 2 that are each put on four corners of the bed 1. The crown 3 is put on the support posts 2, and holds the inner motor 12 and the outer motor 22. The bed 1, the support posts 2, and the crown 3 make up a frame body of the electric press working machine. Incidentally, the number of support posts 2 may not be four; there are at least two support posts 2 to support the crown 3. The support posts 2 may not be formed into a columnar shape and instead may be formed into a plate-like shape.

The inner slide 11 includes a table-like section 11*a*, which is mounted on the support posts 2 so as to be able to move, and a convex section 11*b*, which extends downward from the table-like section 11*a*. According to the present embodiment, four corners of the table-like section 11*a* are put on the support posts 2 so as to be able to slide; the convex section 11*b* is so placed as to extend downward from the center of the table-like section 11*a*.

The inner motor 12 is placed on the crown 3, and drives the inner ball screw 13. As shown in FIG. 2, the inner ball screw 13 includes a screw shaft 13*a* and a nut section 13*b*. The screw shaft 13*a* passes through the crown 3 and is joined to an output shaft of the inner motor 12. The nut section 13*b* is attached to the inner slide 11, and contains a circulating steel ball, which is not shown in the diagram.

According to the present embodiment, four inner motors 12 and four inner ball screws 13 are provided for the four corners of the crown 3 and inner slide 11. The four inner motors 12 and the four inner ball screws 13 work separately. Incidentally, the number of inner motors 12 and the number of inner ball screws 13 are not limited to four; all that required is to provide at least two inner motors 12 and two inner ball screws 13.

The inner linear scale 14 reads the scale post 4, thereby measuring the height of the inner slide 11 relative to the bed 1. According to the present embodiment, four inner linear scales 14 are provided for the four corners of the inner slide 11. Incidentally, all that is required is to provide at least two inner linear scales 14.

The outer slide 21 includes a table-like section 21*a*, which is mounted on the support posts 2 so as to be able to move below the inner slide 11; and a hole section 21*b*, which passes through the table-like section 21*a* in an up-down direction in such a way as to allow the convex section 11*b* of the inner slide 11 to move therethrough. According to the present embodiment, four corners of the table-like section 21*a* are put on the support posts 2 so as to be able to slide; the hole section 21*b* is so provided as to pass through the center of the table-like section 21*a* in such a way as to allow the convex section 11*b* of the inner slide 11 to slide therethrough.

The outer motor 22 is placed on the crown 3, and drives the outer ball screw 23. The outer ball screw 23 includes a screw shaft 23*a* and a nut section 23*b*. The screw shaft 23*a* passes through the crown 3 and the inner slide 11 and is joined to an output shaft of the outer motor 22. The nut section 23*b* is attached to the outer slide 21, and contains a circulating steel ball, which is not shown in the diagram.

According to the present embodiment, four outer motors 22 and four outer ball screws 23 are provided for the four corners of the crown 3 and outer slide 21. The four outer motors 22 and the four outer ball screws 23 work separately. Incidentally, the number of outer motors 22 and the number of outer ball screws 23 are not limited to four; all that required is to provide at least two outer motors 22 and two outer ball screws 23.

The outer linear scale 24 reads the scale post 4, thereby measuring the height of the outer slide 21 relative to the bed 1. According to the present embodiment, four outer linear scales 24 are provided for the four corners of the outer slide 21. Incidentally, all that is required is to provide at least two outer linear scales 24.

One side of each of the scale posts 4 is attached to the bed 1, and the other side to the crown 3 in the vertical direction. According to the present embodiment, the scale posts 4 are mounted on the four outer-side corners of the inner slide 11 and outer slide 21. The inner linear scales 14 and the outer linear scales 24 use the same scale posts 4. Therefore, the number of scale posts 4 provided, the number of inner linear scales 14 provided, and the number of outer linear scales 24 provided are equal.

According to the present embodiment, a press-working operation of to-be-molded articles is repeated automatically. In an actual press-working period, at each stage during one press-working operation, a horizontal state of the inner slide 11 and outer slide 21 can be maintained with high precision.

That is, in a teaching working period that comes before the actual press-working period, at each stage in the midst of progress of one shot of press working: (i) In order to be able to keep the inner slide 11 horizontal, measurement results of the inner linear scales 14 are taken in, and the drive energy that is supplied to each of the four inner motors 12 for driving the inner slide 11 is adjusted and determined, and information about the drive energy supplied to each of the inner motors 12 is stored in a storage device at each stage; and (ii) in order to be able to keep the outer slide 21 horizontal, measurement results of the outer linear scales 24 are taken in, and the drive energy that is supplied to each of the four outer motors 22 for driving the outer slide 21 is adjusted and determined, and information about the drive energy supplied to each of the outer motors 22 is stored in a storage device at each stage.

Then, at each stage in the midst of progress of one shot during press working in the actual working period: (i) To each of the inner motors 12 that drive the inner slide 11, based on the stored information described above, the drive energy is supplied; and (ii) to each of the outer motors 22 that drive the outer slide 21, based on the stored information described above, the drive energy is supplied.

According to the present embodiment, since such control is performed, at each stage of one press working operation, the horizontal state of the inner slide 11 and outer slide 21 can be maintained with high precision. As a result, the clearance between the sliding holes at four corners of the inner slide 11 and the support posts 2 can be set to 0.10 mm to 0.25 mm.

Figure 3:
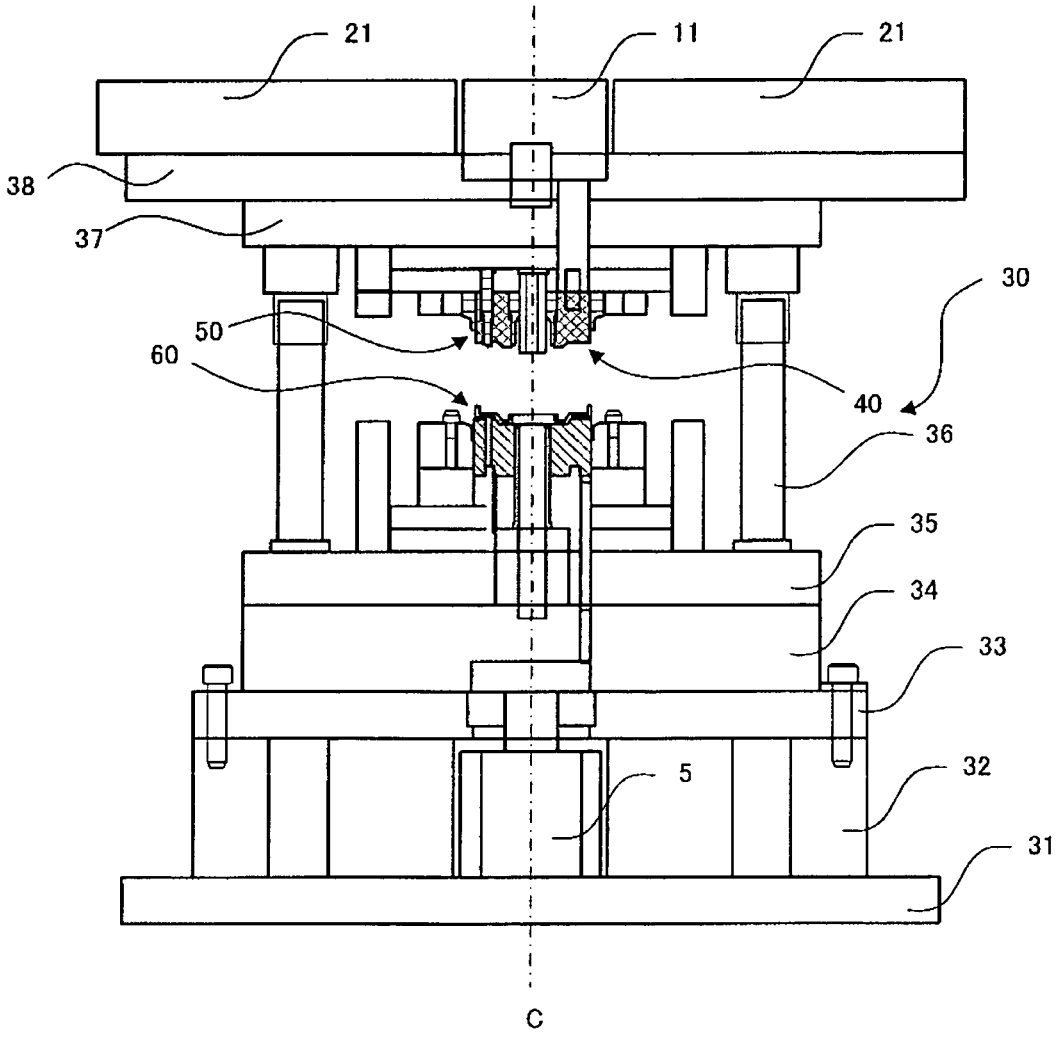
FIG. 3 is a diagram showing an area near a die set section of the electric press working machine.

FIG. 3 is a diagram showing an area near a die set section of the electric press working machine.

On the bed 1 of the electric press working machine P shown in FIG. 1, a die set section 30 is placed. The die set section 30 includes a lower sub-plate 31, which is disposed above the bed 1; leg sections 32, which extend upward from the lower sub-plate 31; a lower spacer plate 33, which is placed on the leg sections 32; a lower spacer 34, which is placed on the lower spacer plate 33; a lower die set 35, which is placed on the lower spacer 34; guide posts 36, which extend upward from four corners of the lower die set 35; an upper die set 37, which includes engagement holes with which the guide posts 36 are so engaged as to be able to move; and an upper sub-plate 38, which is placed on the upper die set 37. On the lower sub-plate 31, a hydraulic cushion 5, which can control a cushion force by controlling a valve and the like, is placed.

Then, the configuration of a die section will be described.

Figure 4:
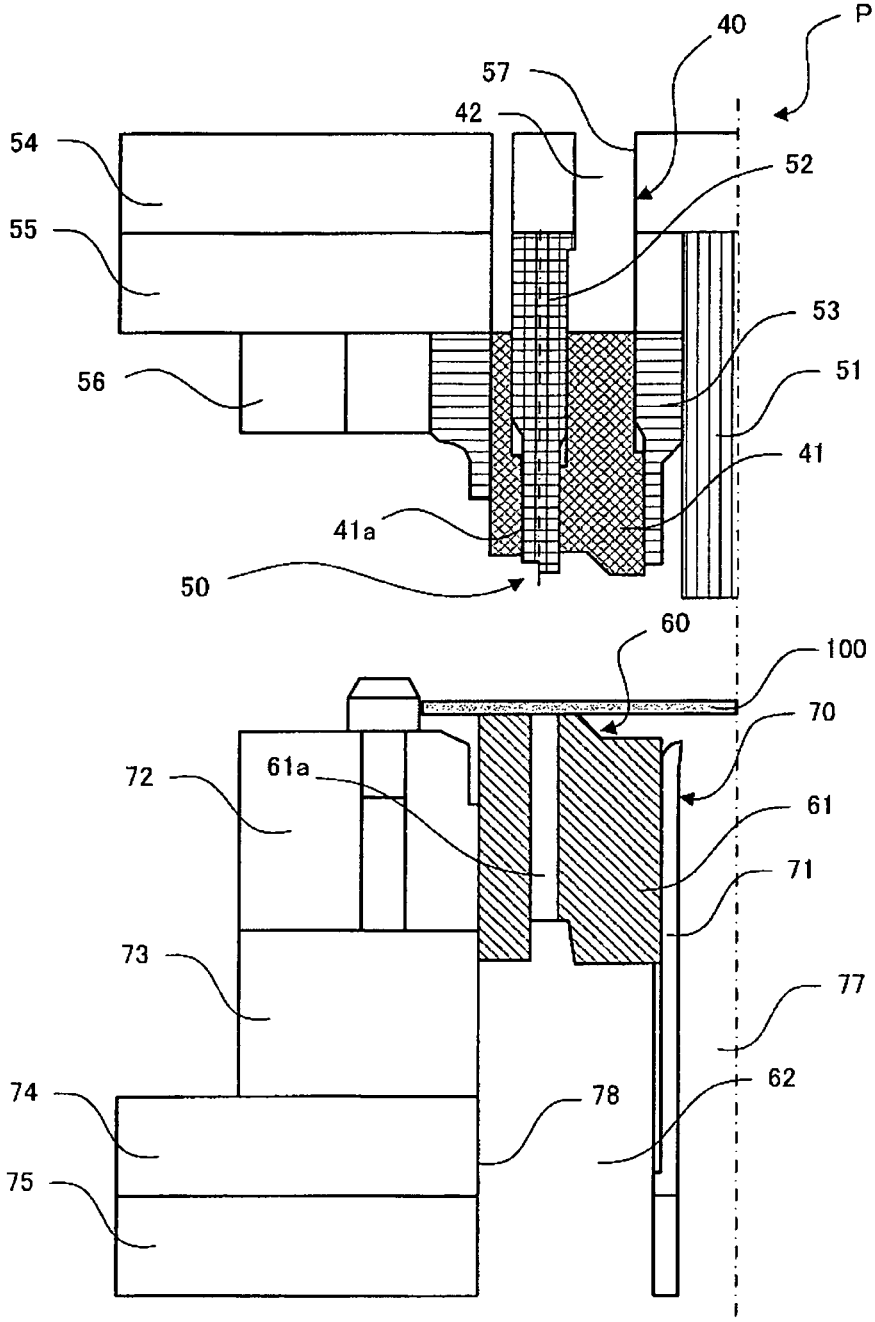
FIG. 4 is a diagram showing the configuration of a die section of the electric press working machine.

FIG. 4 is a diagram showing the configuration of a die section of the electric press working machine.

In the diagram, the reference numeral 40 represents an inner upper die section, which serves as a first upper die. The reference numeral 41 represents an inner upper die. The reference numeral 42 represents a pressure pin. The reference numeral 50 represents an outer upper die section, which serves as a second upper die. The reference numeral 51 represents a first outer upper die. The reference numeral 52 represents a second outer upper die. The reference numeral 53 represents a third outer upper die. The reference numeral 54 represents an upper backing plate. The reference numeral 55 represents an upper punch plate. The reference numeral 56 represents a punch holder. The reference numeral 60 represents a first lower die section, which serves as a lower die. The reference numeral 61 represents a first lower die. The reference numeral 62 represents a cushion connection section. The reference numeral 70 represents a second lower die section, which serves as a lower die. The reference numeral 71 represents a second lower die. The reference numeral 72 represents a die plate. The reference numeral 73 represents a die spacer. The reference numeral 74 represents a lower punch plate. The reference numeral 75 represents a lower backing plate. The reference numeral 100 represents a to-be-molded article.

According to the present embodiment, the inner upper die section 40 includes the annular inner upper die 41 and the annular pressure pin 42, which connects the inner upper die 41 to the inner slide 11 shown in FIG. 3.

The inner upper die 41 includes a first through-hole 41*a* which the second outer upper die 52, which is substantially cylindrical, goes through. The inner upper die 41 is connected to the pressure pin 42 with bolts and the like, and the pressure pint 42 is connected to the inner slide 11 with bolts and the like. Therefore, a pressing force of the inner slide 11 is transmitted to the inner upper die 41 via the pressure pin 42.

According to the present embodiment, the outer upper die section 50 includes the first outer upper die 51, which is cylindrical; the second outer upper die 52; the annular third outer upper die 53; the upper backing plate 54, which connects the first outer upper die 51 and the second outer upper die 52 to the outer slide 21; the upper punch plate 55, which connects the third outer upper die 53 to the upper backing plate 54; and the punch holder 56, which protrudes downward from the upper punch plate 55 and which functions as a stopper together with the die plate 72.

The upper backing plate 54 and the upper punch plate 55 are stacked with bolts and the like, and are mounted on the upper die set 37 shown in FIG. 3 with bolts and the like. The upper backing plate 54 and the upper punch plate 55 have a second through-hole 57 which the pressure pin 42 passes through.

Accordingly, a pressing force of the outer slide 21 is transmitted to the first outer upper die 51 and the second outer upper die 52 via the upper sub-plate 38, the upper die set 37, and the upper backing plate 54, and to the third outer upper die 53 via the upper backing plate 54 and the upper punch plate 55.

According to the present embodiment, the first lower die section 60 includes the annular first lower die 61 and the cushion connection section 62, which connects the first lower die 61 to the hydraulic cushion 5.

The first lower die 61 is so disposed as to face the inner upper die 41. Because of the pressing force of the inner slide 11, the first lower die 61 supports the to-be-molded article 100 from the lower side while the to-be-molded article 100 is pressed by the inner upper die 41 from the upper side. Moreover, the first lower die 61 can move downward together with the cushion connection section 62 because of the pressing force of the inner slide 11, as the cushion force of the hydraulic cushion 5 is adjusted. The first lower die 61 includes a third through-hole 61*a* which the second outer upper die 52 can enter.

According to the present embodiment, the second lower die section 70 includes the annular second lower die 71, the die plate 72, the die spacer 73, the lower punch plate 74, and the lower backing plate 75.

The lower backing plate 75 is placed on the lower die set 35 shown in FIG. 3. On the lower backing plate 75, the lower punch plate 74 is placed. On the lower punch plate 74, the die spacer 73 is placed. On the die spacer 73, the die plate 72 is placed.

A fourth through-hole 77 is made at the centers of the die plate 72, die spacer 73, lower punch plate 74, and lower backing plate 75 to allow the first outer upper die 51 to move therethrough. The second lower die 71 is placed inside the fourth through-hole 77 on the lower backing plate 75 in an annular manner.

The die plate 72, the die spacer 73, the lower punch plate 74, and the lower backing plate 75 have, on the outer periphery of the second lower die 71, a fifth through-hole 78 through which the first lower die 61 and the cushion connection section 62 can move.

Then, an operation process of the electric press working machine will be described.

Figure 5:
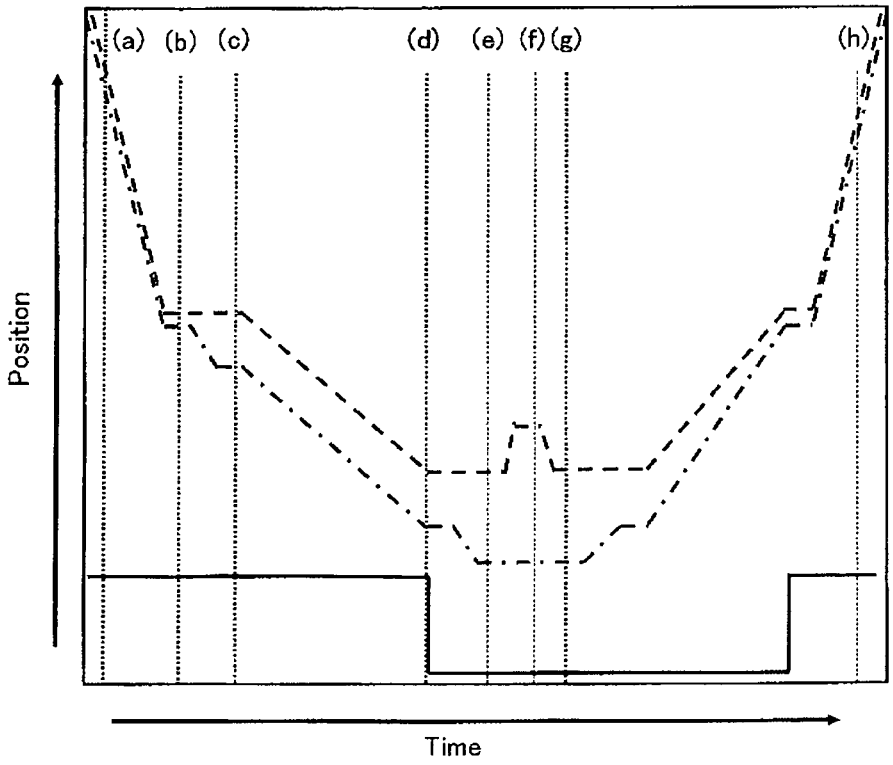
FIG. 5 is a diagram showing operation states of a first example of an electric press working machine.
Figure 6:
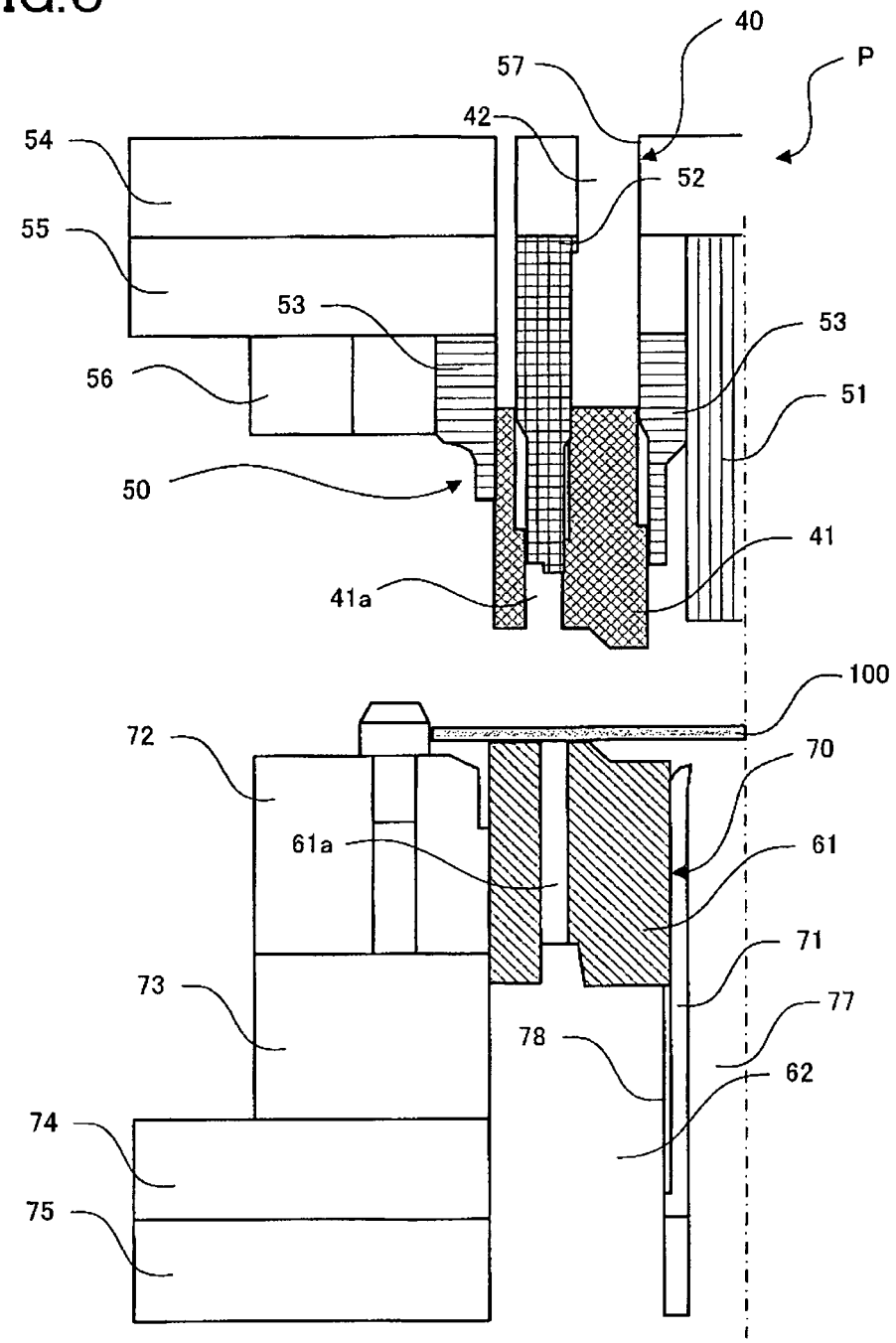
FIG. 6 is a diagram showing a state (a) of FIG. 5.
Figure 7:
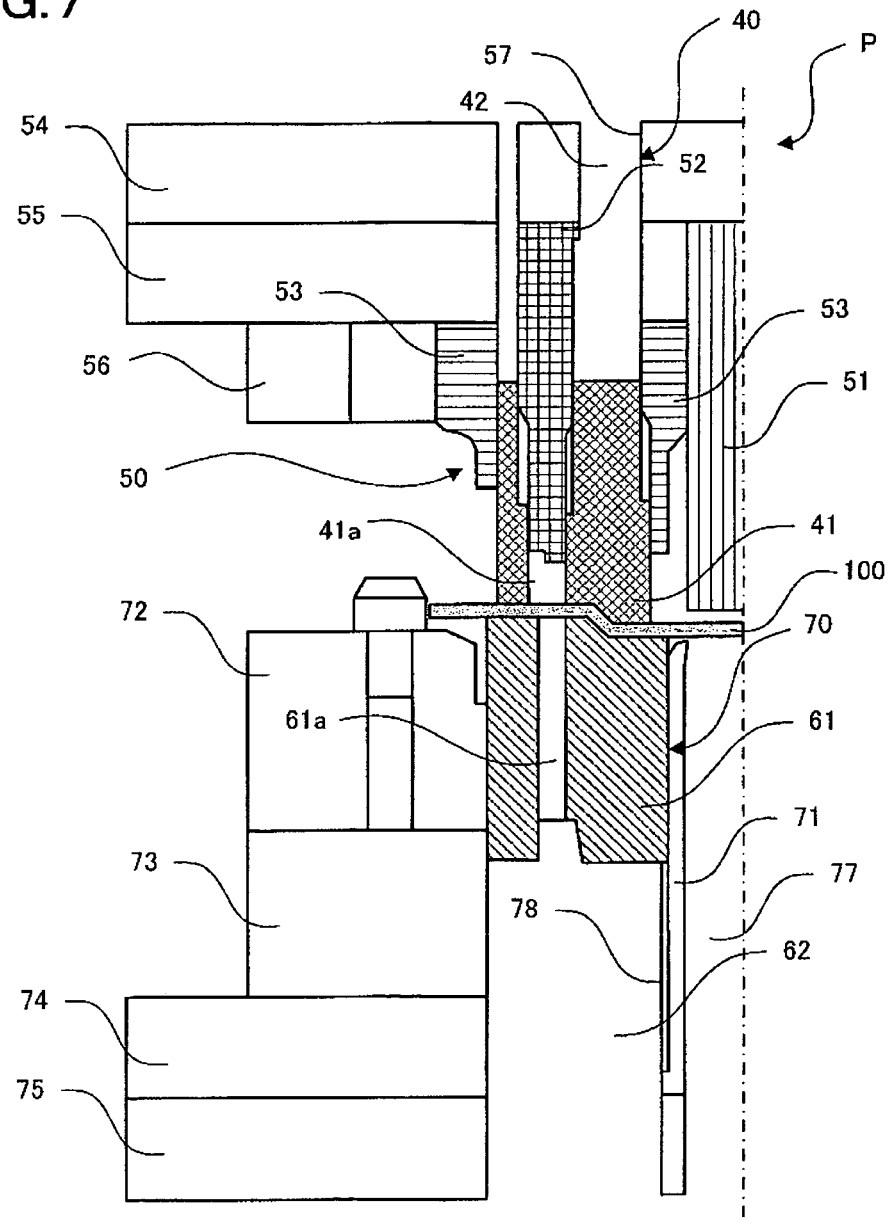
FIG. 7 is a diagram showing a state (b) of FIG. 5.
Figure 8:
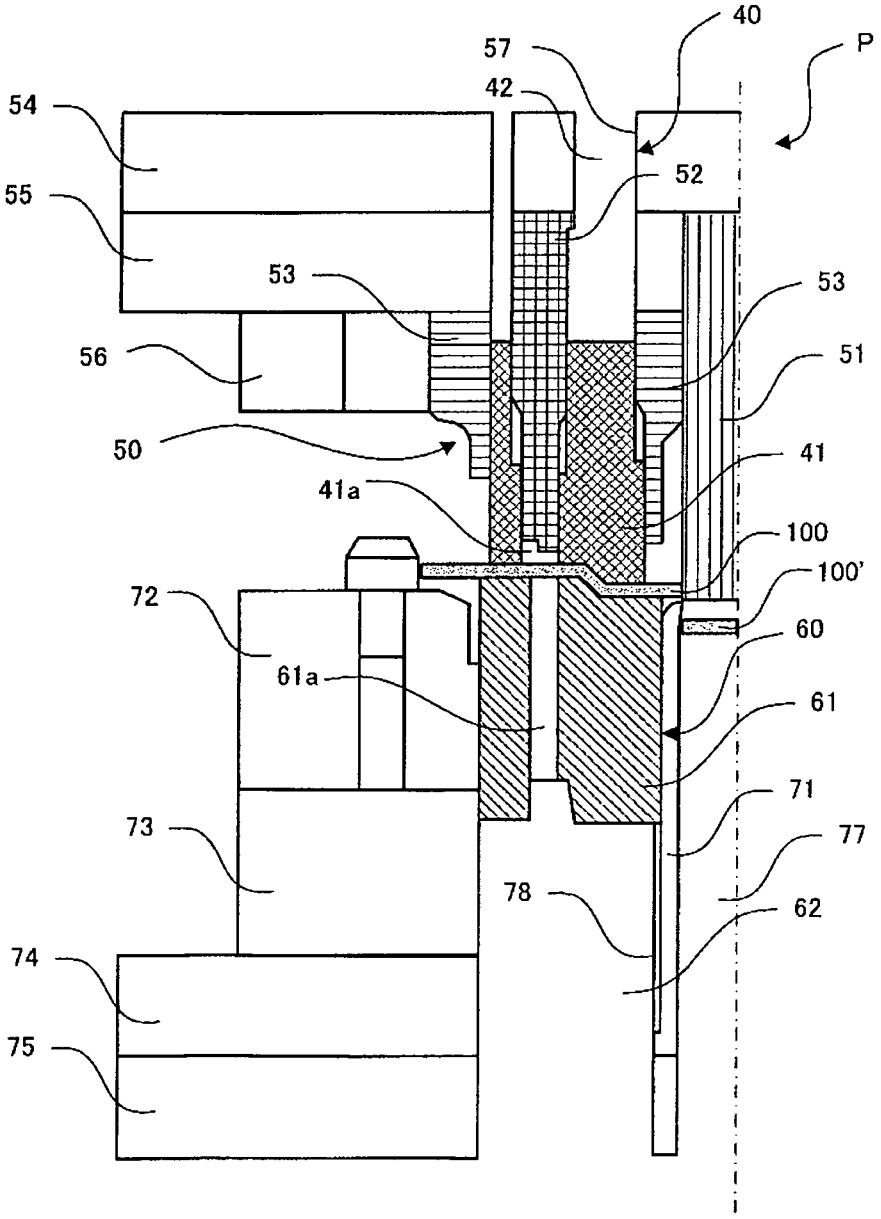
FIG. 8 is a diagram showing a state (c) of FIG. 5.
Figure 9:
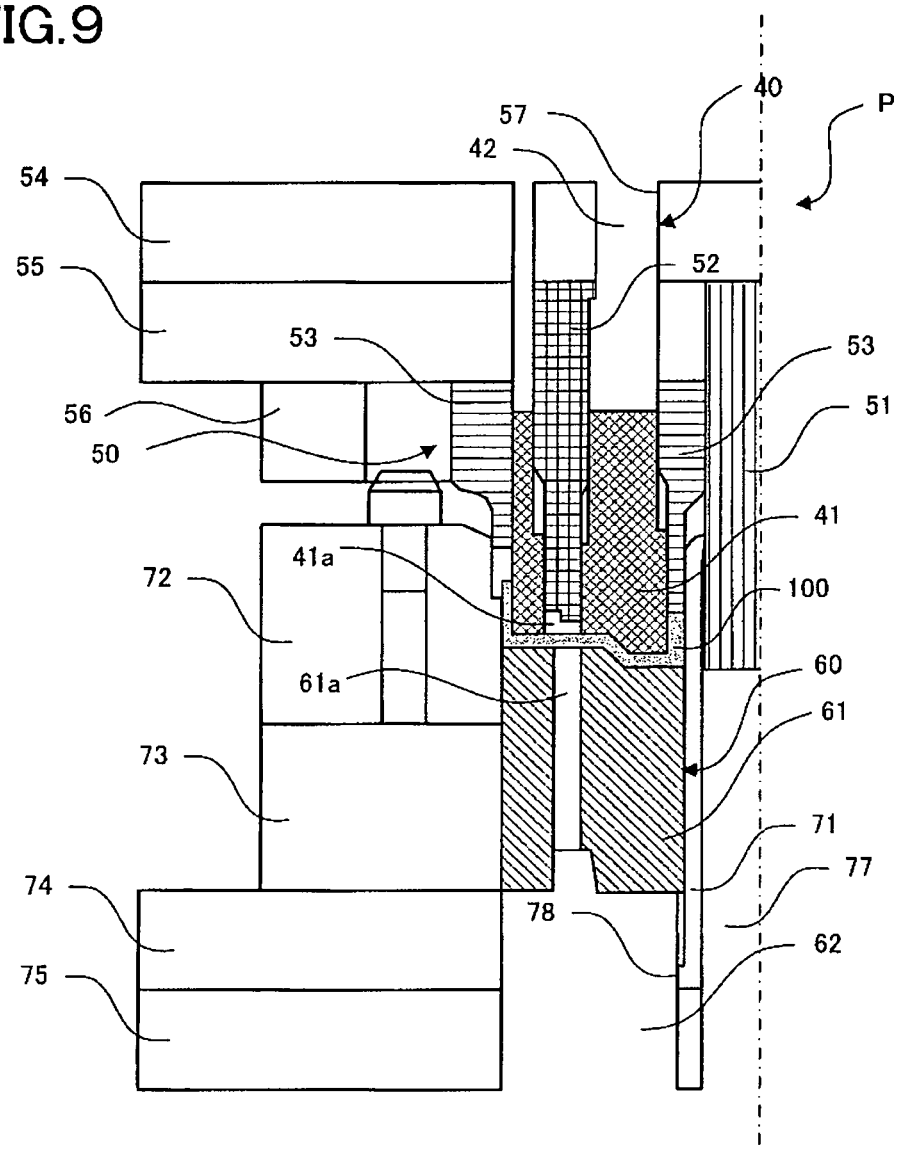
FIG. 9 is a diagram showing a state (d) of FIG. 5.
Figure 10:
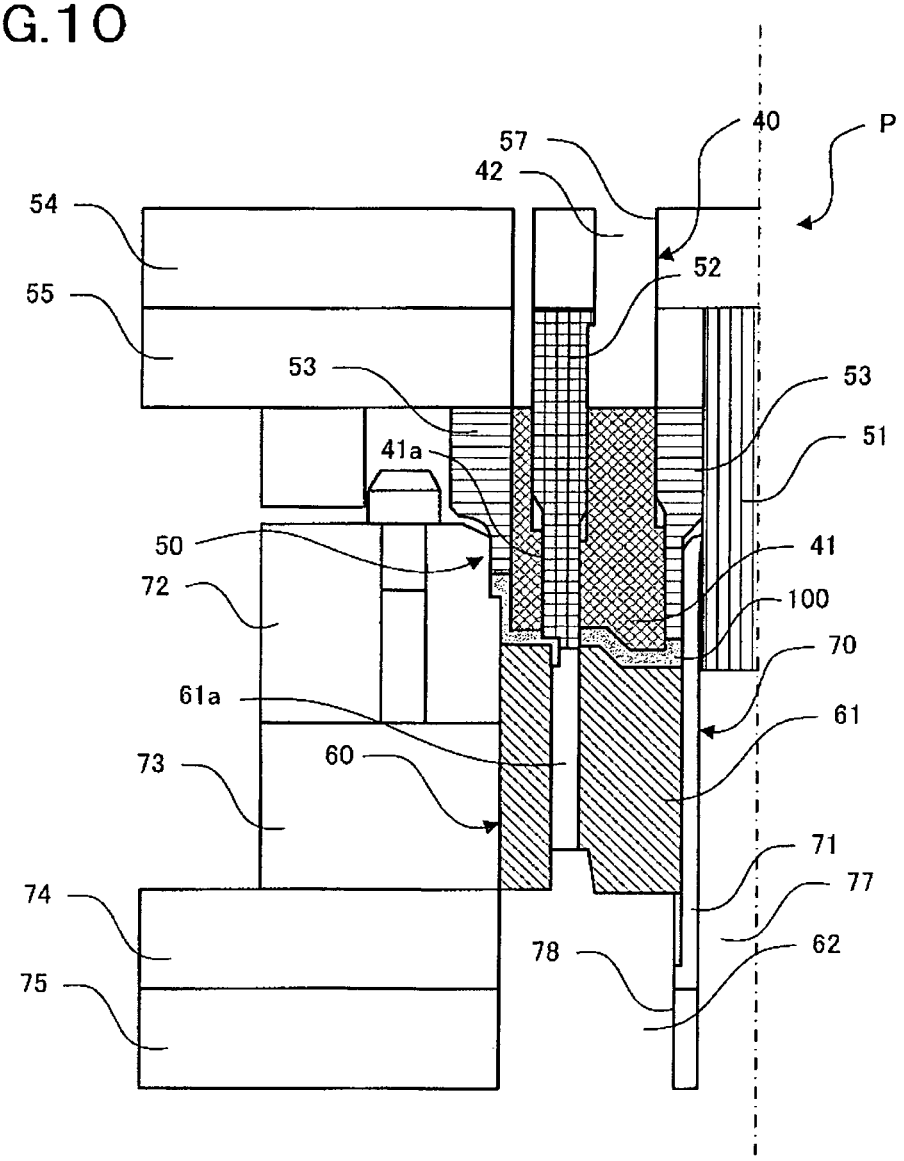
FIG. 10 is a diagram showing a state (e) of FIG. 5.
Figure 11:
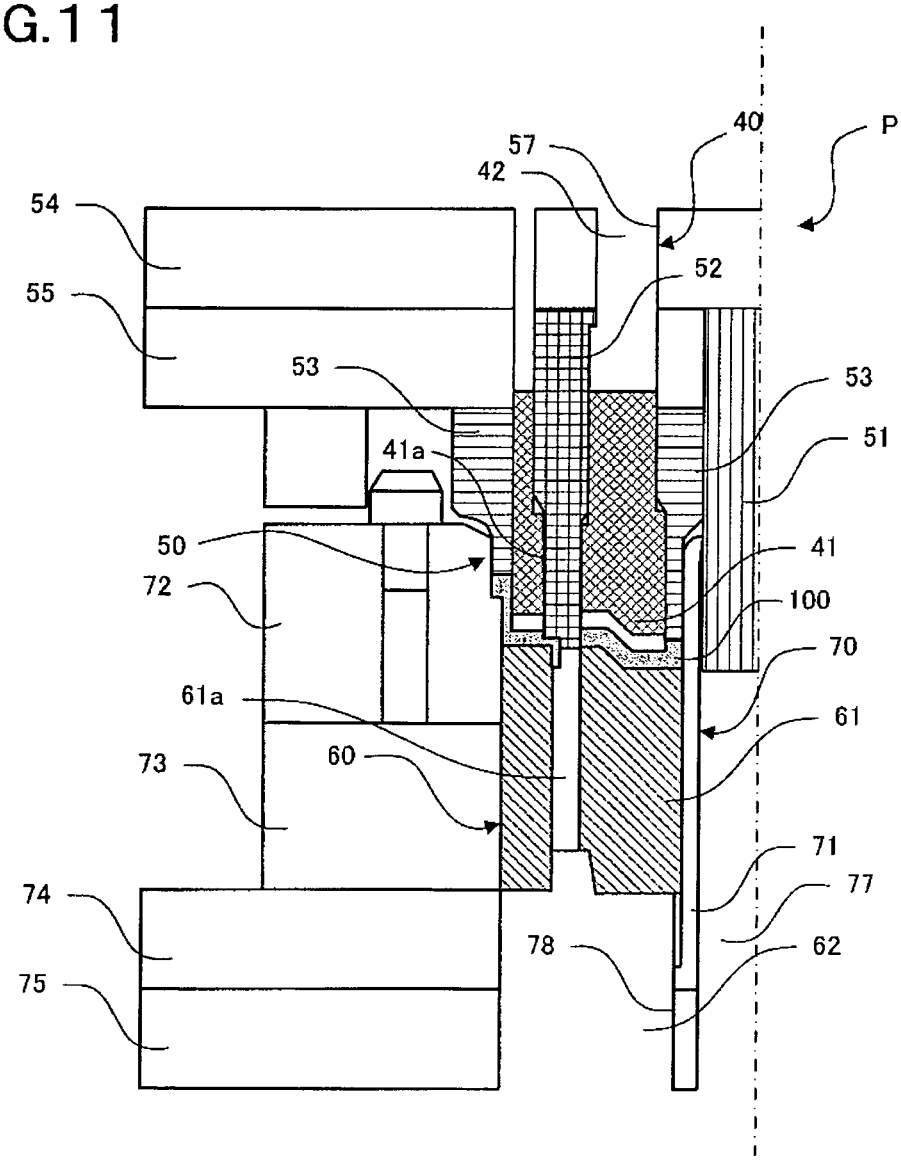
FIG. 11 is a diagram showing a state (f) of FIG. 5.
Figure 12:
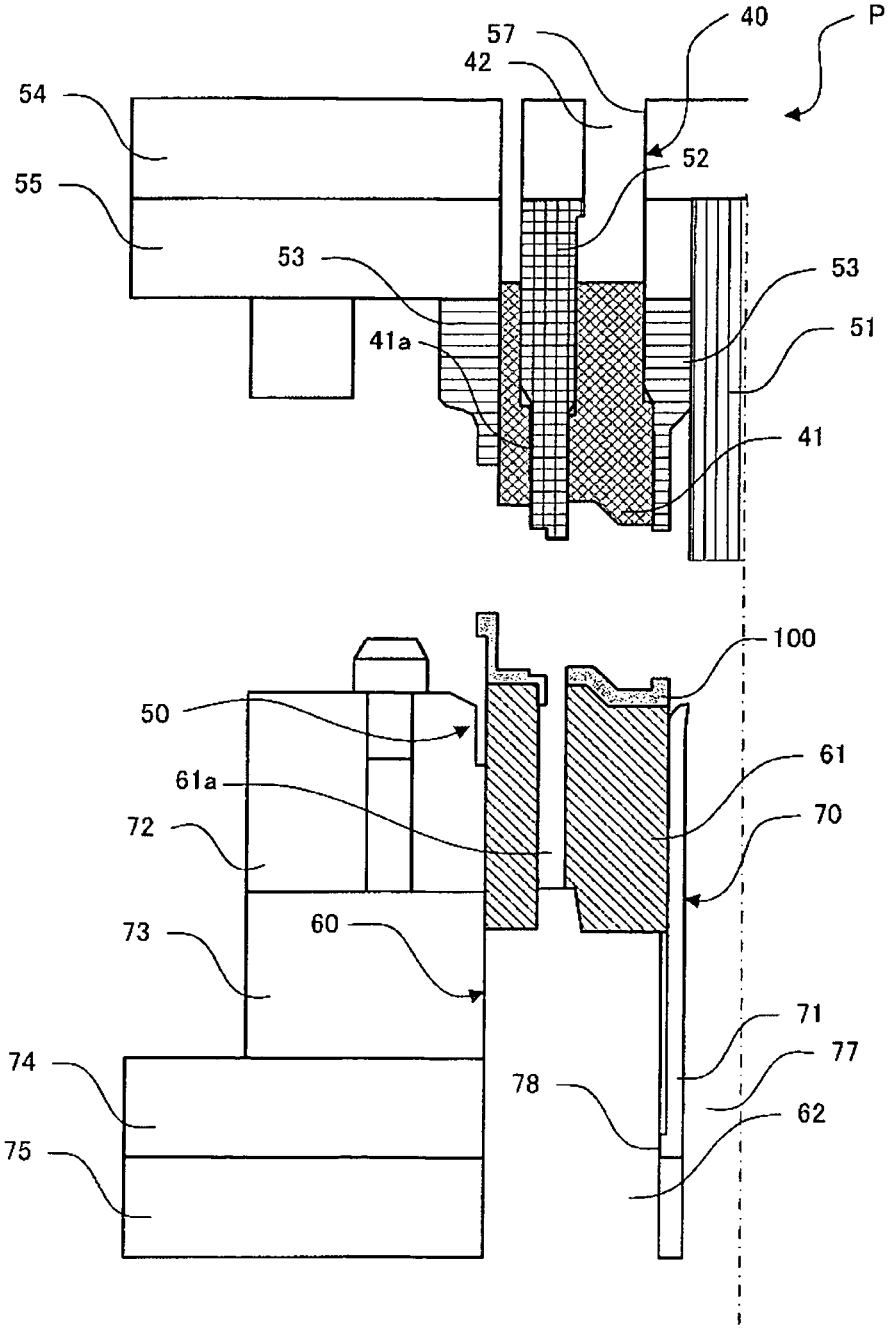
FIG. 12 is a diagram showing a state (g) of FIG. 5.
Figure 13:
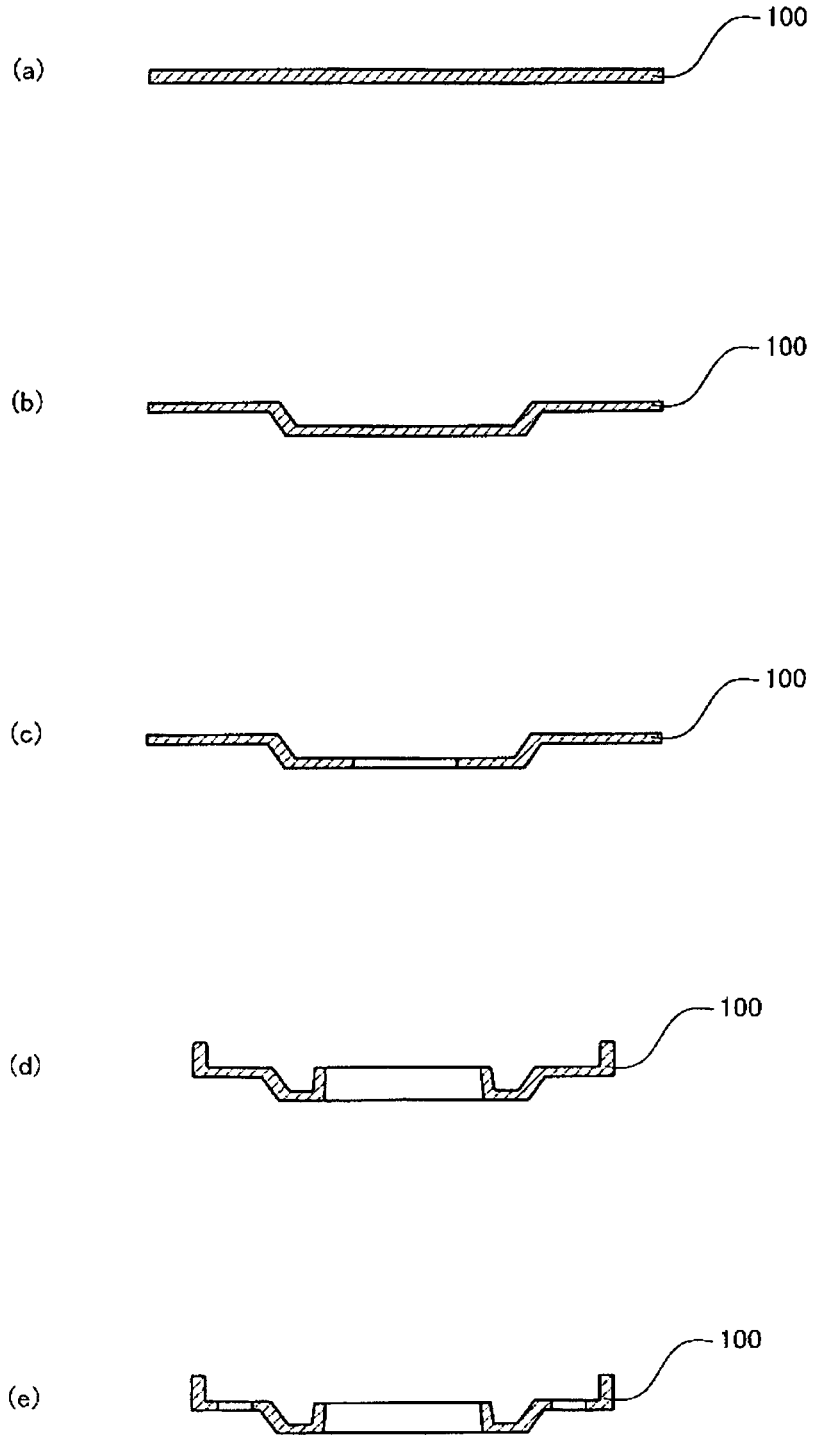
FIG. 13 is a diagram showing the state of a molded article in each state of FIG. 5.

FIG. 5 is a diagram showing operation states of a first example of the electric press working machine. FIG. 6 is a diagram showing a state (a) of FIG. 5. FIG. 7 is a diagram showing a state (b) of FIG. 5. FIG. 8 is a diagram showing a state (c) of FIG. 5. FIG. 9 is a diagram showing a state (d) of FIG. 5. FIG. 10 is a diagram showing a state (e) of FIG. 5. FIG. 11 is a diagram showing a state (f) of FIG. 5. FIG. 12 is a diagram showing a state (g) of FIG. 5. FIG. 13 is a diagram showing the state of a molded article in each state of FIG. 5. Incidentally, FIGS. 6 to 12 show a left half with respect to a center line C in FIG. 3.

In FIG. 5, the horizontal axis represents time, the vertical axis represents position, the solid line represents motion of the hydraulic cushion, the broken line represents motion of the inner slide, and the alternate long and short dash line represents motion of the outer slide.

In the state (a) of FIG. 5, as shown in FIG. 6, the inner slide 11 and outer slide 21 of the electric press working machine P are in a pre-operation state, and are at predetermined initial positions. The to-be-molded article 100 is a flat plate as shown in FIG. 13(*a*).

From the state (a) of FIG. 5, as the inner motors 12 shown in FIG. 1 start to be driven, the inner ball screws 13 start to operate, and the inner slide 11 move downward in the vertical direction along the support posts 2. Moreover, as the outer motors 22 shown in FIG. 1 start to be driven, the outer ball screws 23 start to operate, and the outer slide 21 moves downward in the vertical direction along the support posts 2.

Initially, the inner slide 11 and the outer slide 21 go down at the same time as shown in FIG. 5(*b*). First, the inner upper die 41 comes in contact with an upper side of the to-be-molded article 100, and a lower side of the to-be-molded article 100 comes in contact with the first lower die 61. Then, as shown in FIG. 7, the to-be-molded article 100 is held between the inner upper die 41 and the first lower die 61, and steps are made; the to-be-molded article 100 is turned into a state of FIG. 13(*b*) as a result.

Then, until the state (c) of FIG. 5, only the outer slide 21 is lowered. Then, the outer upper die section 50 goes down. At this time, the to-be-molded article 100 is held between the inner upper die 41 and the first lower die 61. Moreover, as shown in FIG. 8, the to-be-molded article 100 is pressed by the first outer upper die 51 from the upper side, and at the same time is supported by the second lower die 71 from the lower side. Therefore, a hole is made in a central portion 100' at the boundary between the first outer upper die 51 and the second lower die 71, and the to-be-molded article 100 is turned into a state of FIG. 13(*c*).

Furthermore, until the state (d) of FIG. 5, the inner slide 11 and the outer slide 21 are lowered. Then, the hydraulic cushion 5 is moved downward. Since the lower side of the first lower die 61 is supported by the hydraulic cushion 5, the first lower die 61 goes down. However, the lower sides of the second lower die 71 and the die plate 72 are fixed. Accordingly, as shown in FIG. 9, the to-be-molded article 100 is pressed by the second lower die 71 and the die plate 72 from the lower side, and the external shape thereof is made narrower. Moreover, the inner diameter thereof is subjected to burring. As a result, the to-be-molded article 100 is turned into a state of FIG. 13(*d*).

Furthermore, the outer slide 21 is lowered until the outer slide 21 reaches a predetermined position shown in FIG. 5(*e*). As shown in FIG. 10, the second outer upper die 52 and the third outer upper die 53 go down, pressing the to-be-molded article 100 from the upper side. The second outer upper die 52 is inserted into the third through-hole 61*a*, thereby making a hole at the boundary between the second outer upper die 52 and the first lower die 61.

Moreover, the to-be-molded article 100 is pressed by the third outer upper die 53 from the upper side while being supported by the second lower die 71 and the die plate 72 from the lower side. In this manner, an edge portion thereof is thickened. As a result, the molding of the to-be-molded article 100 is almost complete as shown in FIG. 13(*e*). The position of the inner slide 11 at this time is referred to as a first position.

After that, as in the state (f) of FIG. 5, the outer slide 21 is kept at the predetermined position, while the inner slide 11 is moved upward to a second position. That is, the inner motors 12 shown in FIG. 1 are driven and rotated in a direction opposite to that of FIG. 5(*a*); the inner ball screws 13 therefore start to operate, and the inner slide 11 moves upward in the vertical direction along the support posts 2. Therefore, as shown in FIG. 11, the to-be-molded article 100 is held in such a way as to be in contact with the second outer upper die 52, the third outer upper die 53, the first lower die 61, the second lower die 71, and the die plate 72, while being separated from the first inner upper die 41.

Then, only the inner slide 11 is moved downward again to a third position. Then, a state (g) of FIG. 5 emerges. Again, as shown in FIG. 10, the to-be-molded article 100 is held in such a way as to be in contact with the second outer upper die 52, the third outer upper die 53, the first lower die 61, the second lower die 71, and the die plate 72, while coming in contact with and being pressed by the first inner upper die 41.

After that, as in the state (h) of FIG. 5, the inner motors 12 and outer motors 22 shown in FIG. 1 are driven and rotated in a direction opposite to that of FIG. 5(*a*). Then, the outer ball screws 23 start to operate, and the outer slide 21 moves upward in the vertical direction along the support posts 2. Then, the inner slide 11 and the outer slide 21 go up together. As shown in FIG. 12, the inner upper die 41, the first outer upper die 51, the second outer upper die 52, and the third outer upper die 53 go up and move away from the to-be-molded article 100. As a result, the to-be-molded article 100 can be taken out.

The electric press working machine P of the first example includes a step of once moving the inner slide 11 and the outer slide 21 to the first position as in the state (e) of FIG. 5; a step of moving the inner slide 11 to the higher second position while keeping the outer slide 21 at the first position as in the state (f) of FIG. 5; and a step of moving the inner slide 11 to a third position that is slightly lower than the first position, while keeping the outer slide 21 at the first position as in the state (g) of FIG. 5.

The third position is slightly lower than the first position. Therefore, compared with the case where the inner slide 11 and the outer slide 21 are moved to the third position at once, the burden that is put on the to-be-molded article during one molding process becomes smaller. Accordingly, at the step of moving the inner slide 11 and the outer slide 21 to the first position, the to-be-molded article is tentatively molded to a certain degree. At the step of moving the inner slide 11 to the third position that is slightly lower than the first position, the flatness of the to-be-molded article is ensured, and high-precision molding can be performed. As a result, it is unnecessary to carryout a finishing step, which is required in the conventional case, after the pressing.

Incidentally, the first position and the third position may be the same position. In this case, it becomes easier to control, as well as to add other steps.

Other examples will be described.

Figure 14:
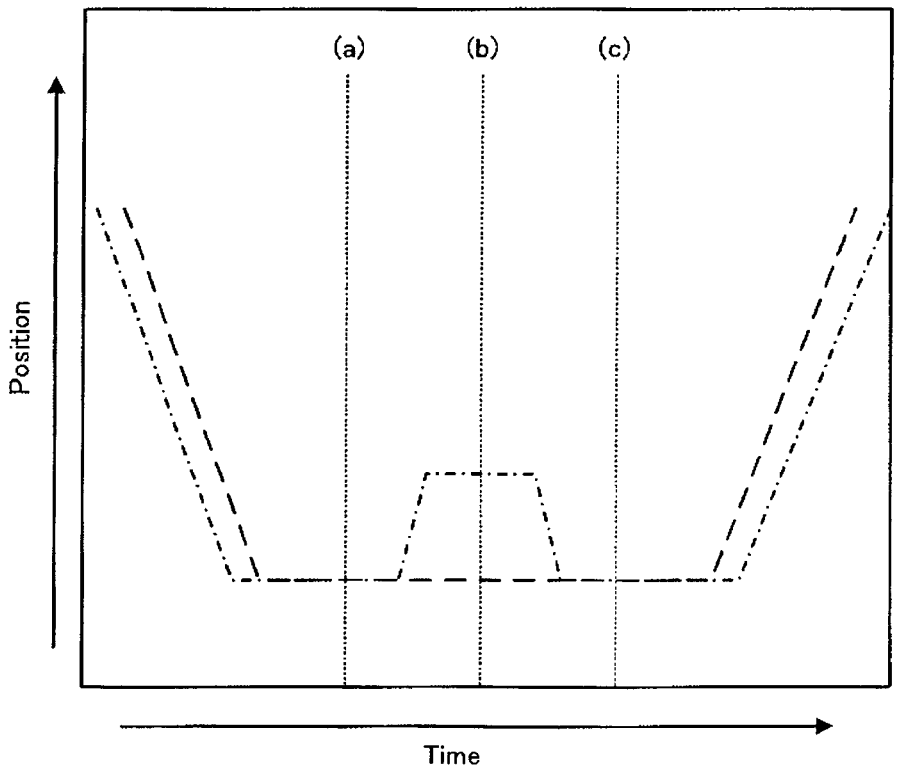
FIG. 14 is a diagram showing operation states of a second example of an electric press working machine.

FIG. 14 is a diagram showing operation states of a second example of the electric press working machine.

In FIG. 14, the horizontal axis represents time, the vertical axis represents position, the solid line represents motion of the hydraulic cushion, the broken line represents motion of the inner slide, and the alternate long and short dash line represents motion of the outer slide.

The electric press working machine P of the second example includes a step of once moving the inner slide 11 and the outer slide 21 to a predetermined first position as in the state (a) of FIG. 14; a step of moving the outer slide 21 to a higher second position while keeping the inner slide 11 at the predetermined first position as in the state (b) of FIG. 14; and a step of moving the outer slide 21 again to the predetermined first position while keeping the inner slide 11 at the predetermined first position as in the state (c) of FIG. 14.

The electric press working machine P includes the above steps. Therefore, the flatness of the to-be-molded article is ensured, and high-precision molding can be performed. As a result, it is unnecessary to carry out a finishing step, which is required in the conventional case, after the pressing.

Figure 15:
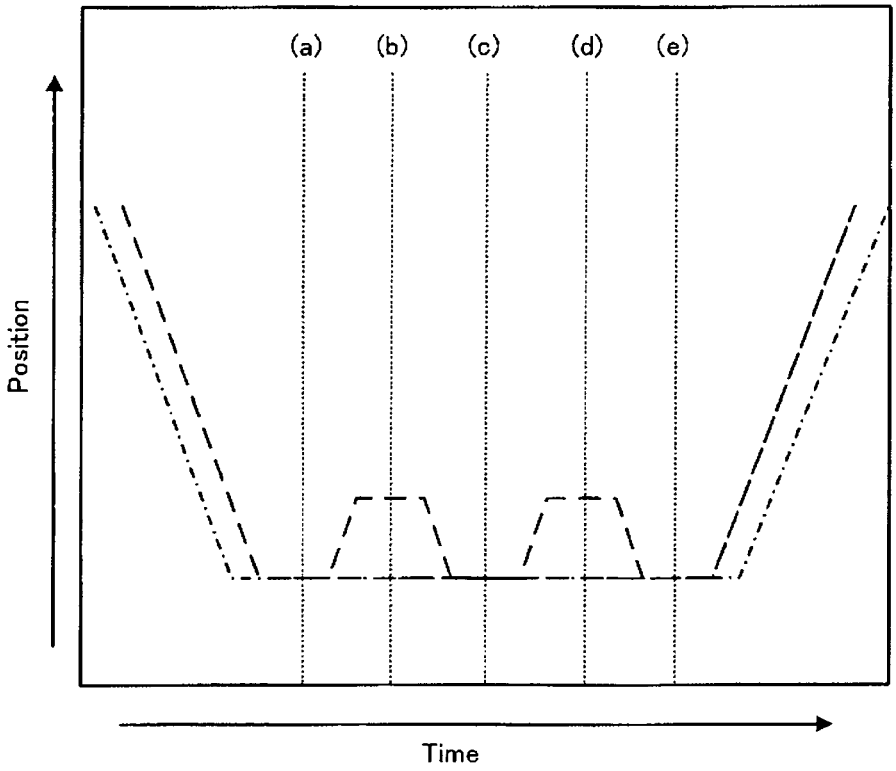
FIG. 15 is a diagram showing operation states of a third example of an electric press working machine.

FIG. 15 is a diagram showing operation states of a third example of the electric press working machine.

In FIG. 15, the horizontal axis represents time, the vertical axis represents position, the solid line represents motion of the hydraulic cushion, the broken line represents motion of the inner slide, and the alternate long and short dash line represents motion of the outer slide.

The electric press working machine P of the third example includes a step of once moving the inner slide 11 and the outer slide 21 to a predetermined first position as in the state (a) of FIG. 15; a step of moving the inner slide 11 to a higher second position while keeping the outer slide 21 at the predetermined first position as in the state (b) of FIG. 15; a step of moving the inner slide 11 again to the predetermined first position while keeping the outer slide 21 at the predetermined first position as in the state (c) of FIG. 15; a step of moving the inner slide 11 to the higher second position while keeping the outer slide 21 at the predetermined first position as in the state (d) of FIG. 15; and a step of moving the inner slide 11 again to the predetermined first position while keeping the outer slide 21 at the predetermined first position as in the state (e) of FIG. 15.

In that manner, with regard to the inner slide 11 or the outer slide 21, a step of moving a second slide to the higher second position while keeping a first slide at the predetermined first position, and a step of moving the second slide again to the predetermined first position while keeping the first slide at the predetermined first position are performed a plurality of times. Therefore, the flatness of the to-be-molded article is ensured, and high-precision molding can be performed. As a result, it is unnecessary to carry out a finishing step, which is required in the conventional case, after the pressing.

Figure 16:
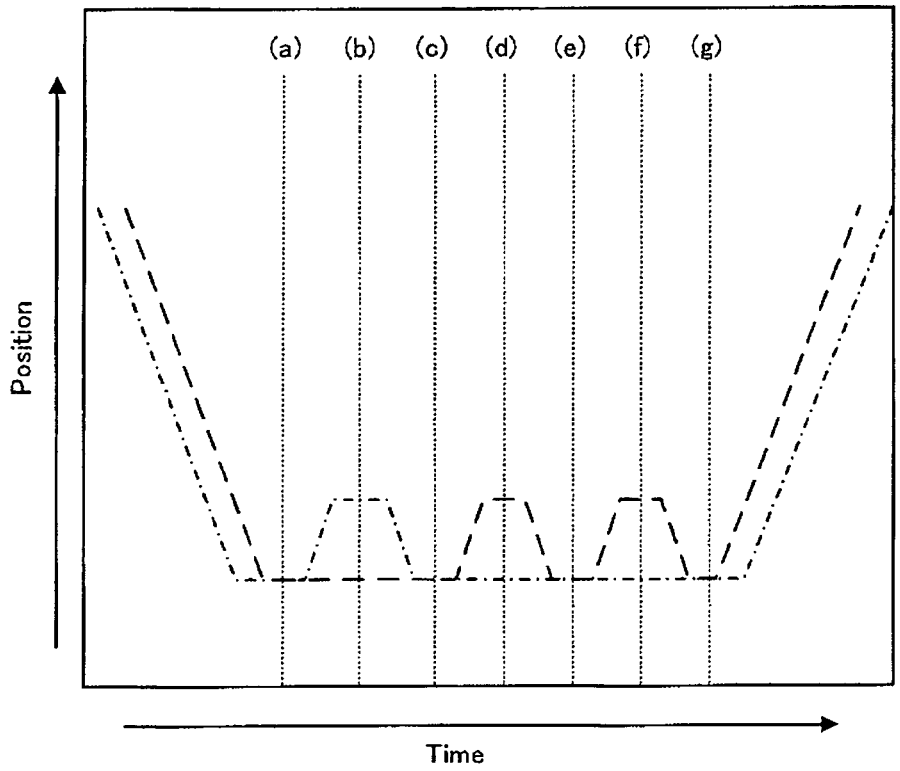
FIG. 16 is a diagram showing operation states of a fourth example of an electric press working machine.

FIG. 16 is a diagram showing operation states of a fourth example of the electric press working machine.

In FIG. 16, the horizontal axis represents time, the vertical axis represents position, the solid line represents motion of the hydraulic cushion, the broken line represents motion of the inner slide, and the alternate long and short dash line represents motion of the outer slide.

The electric press working machine P of the fourth example includes a step of once moving the inner slide 11 and the outer slide 21 to a predetermined position as in the state (a) of FIG. 16; a step of moving the outer slide 21 upward while keeping the inner slide 11 at the predetermined position as in the state (b) of FIG. 16; a step of moving the outer slide 21 again to the predetermined position while keeping the inner slide 11 at the predetermined position as in the state (c) of FIG. 16; a step of moving the inner slide 11 upward while keeping the outer slide 21 at the predetermined position as in the state (d) of FIG. 16; a step of moving the inner slide 11 again to the predetermined position while keeping the outer slide 21 at the predetermined position as in the state (e) of FIG. 16; a step of moving the inner slide 11 upward while keeping the outer slide 21 at the predetermined position as in the state (f) of FIG. 16; and a step of moving the inner slide 11 again to the predetermined position while keeping the outer slide 21 at the predetermined position as in the state (g) of FIG. 16.

In that manner, with regard to the inner slide 11 or the outer slide 21, a step of moving a second slide to a higher second position while keeping a first slide at a predetermined first position, a step of moving the second slide again to the predetermined first position while keeping the first slide at the predetermined first position, a step of moving the first slide to the higher second position while keeping the second slide at the predetermined first position, and a step of moving the first slide again to the predetermined first position while keeping the second slide at the predetermined first position are performed. Therefore, the flatness of a surface of the to-be-molded article, which is pressed in such a way as to correspond to both the inner slide 11 and the outer slide 21, is ensured, and high-precision molding can be performed. As a result, it is unnecessary to carry out a finishing step, which is required in the conventional case, after the pressing.

Figure 17:
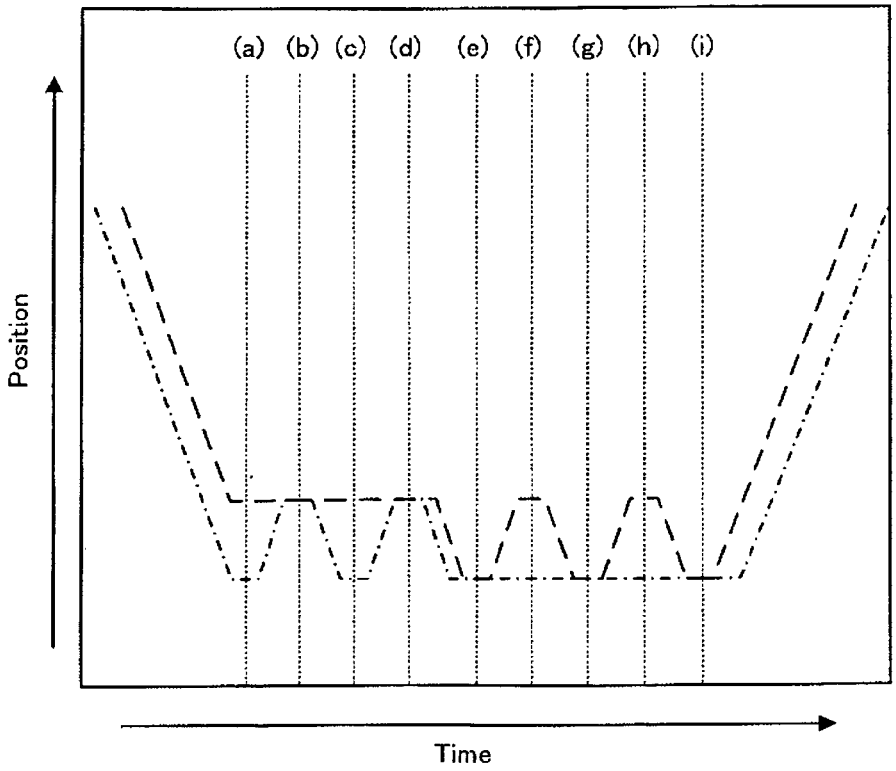
FIG. 17 is a diagram showing operation states of a fifth example of an electric press working machine.

FIG. 17 is a diagram showing operation states of a fifth example of the electric press working machine.

In FIG. 17, the horizontal axis represents time, the vertical axis represents position, the solid line represents motion of the hydraulic cushion, the broken line represents motion of the inner slide, and the alternate long and short dash line represents motion of the outer slide.

The electric press working machine P of the fifth example includes a step of moving the inner slide 11 to a second position corresponding to an upper surface of the to-be-molded article, and moving the outer slide 21 to a predetermined first position that is lower than the second position corresponding to the upper surface of the to-be-molded article as in the state (a) of FIG. 17; a step of moving the outer slide 21 to the higher second position while keeping the inner slide 11 at the predetermined second position as in the state (b) of FIG. 17; a step of moving the outer slide 21 again to the predetermined first position while keeping the inner slide 11 at the predetermined second position as in the state (c) of FIG. 17; a step of moving the outer slide 21 to the higher second position while keeping the inner slide 11 at the predetermined second position as in the state (d) of FIG. 17; a step of moving the inner slide 11 and the outer slide 21 to the predetermined first position as in the state (e) of FIG. 17; a step of moving the inner slide 11 to the higher second position while keeping the outer slide 21 at the predetermined first position as in the state (f) of FIG. 17; a step of moving the inner slide 11 again to the predetermined first position while keeping the outer slide 21 at the predetermined first position as in the state (g) of FIG. 17; a step of moving the inner slide 11 to the higher second position while keeping the outer slide 21 at the predetermined first position as in the state (h) of FIG. 17; and a step of moving the inner slide 11 again to the predetermined first position while keeping the outer slide 21 at the predetermined first position as in the state (i) of FIG. 17.

In that manner, with regard to the inner slide 11 or the outer slide 21, a step of moving a second slide to the first position while keeping a first slide at the second position, a step of moving the second slide to the second position while keeping the first slide at the second position, a step of moving the first and second slides to the first position, a step of moving the first slide to the second position while keeping the second slide at the first position, and a step of moving the first slide to the first position while keeping the second slide at the first position are performed. Therefore, the flatness of a surface of the to-be-molded article, which is pressed in such a way as to correspond to both the inner slide 11 and the outer slide 21, is ensured, and high-precision molding can be performed. As a result, it is unnecessary to carry out a finishing step, which is required in the conventional case, after the pressing.

EXPLANATION OF REFERENCE SYMBOLS

1: Bed (frame body)
2: Support post (frame body)
3: Crown (frame body)
4: Scale post
5: Hydraulic cushion
11: Inner slide (first slide)
12: Inner motor (first-side drive source)
13: Inner ball screw
14: Inner linear scale
21: Outer slide (second slide)
22: Outer motor (second-side drive source)
23: Outer ball screw
24: Outer linear scale
30: Die set
31: Lower sub-plate
32: Leg section
33: Lower spacer plate
40: Inner upper die section (first upper die)
41: Inner upper die
41*a*: First through-hole
42: Pressure pin
50: Outer upper die section (second upper die)
51: First outer upper die
52: Second outer upper die
53: Third outer upper die
54: Upper backing plate
55: Upper punch plate
56: Punch holder
57: Second through-hole
60: First lower die section (lower die)
61: First lower die
61*a*: Third through-hole
62: Cushion connection section
70: Second lower die section (lower die)
71: Second lower die
72: Die plate
73: Die spacer
74: Lower punch plate
75: Lower backing plate
77: Fourth through-hole
78: Fifth through-hole
100: To-be-molded article

The invention claimed is:

1. An operation method of an electric press working machine at least including a frame body that is formed by using a bed, a crown, and a plurality of support posts, a first slide that slides on the support posts, a second slide that slides on the support posts, a first-side drive source that is so provided as to drive the first slide, a second-side drive source that is so provided as to drive the second slide, and a first upper die that is so attached as to correspond to the first slide, and a second upper die that is so attached as to correspond to the second slide, wherein the first-side drive source repeatedly raises or lowers the first slide, and the second-side drive source repeatedly raises or lowers the second slide, and a press working operation of processing a to-be-molded article by using a lower die, which is so attached as to correspond to the bed, and the first and second upper dies is continuously repeated, the operation method characterized by comprising:

a step of moving the first and second slides to a first position;

a step of moving the second slide to a second position while keeping the first slide at the first position; and a step of moving the second slide to a third position while keeping the first slide at the first position.

2. The operation method of the electric press working machine according to claim 1, characterized in that the first position and the third position are the same position.

3. The operation method of the electric press working machine according to claim 1, characterized by comprising:

a step of moving the second slide to the third position while keeping the first slide at the first position;

a step of then moving the second slide to a fourth position while keeping the first slide at the first position; and a step of moving the second slide to a fifth position while keeping the first slide at the first position.

4. The operation method of the electric press working machine according to claim 3, characterized in that:

the first position, the third position, and the fifth position are the same position; and the second position and the fourth position are the same position.

5. The operation method of the electric press working machine according to claim 2, characterized by comprising:

a step of moving the first slide to the second position while keeping the second slide at the first position; and a step of moving the first slide to the first position while keeping the second slide at the first position.

6. The operation method of the electric press working machine according to claim 2, characterized by comprising:

a step of moving the first slide to the second position, and the second slide to the first position;

a step of moving the second slide to the second position while keeping the first slide at the second position; and a step of moving the first slide and the second slide to the first position.

* * * * *